US009424970B2

(12) United States Patent
Jin et al.

(10) Patent No.: US 9,424,970 B2
(45) Date of Patent: Aug. 23, 2016

(54) HIGH-K TRANSFORMERS EXTENDING INTO MULTIPLE DIELECTRIC LAYERS

(75) Inventors: Jun-De Jin, Hsin-Chu (TW); Tzu-Jin Yeh, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 581 days.

(21) Appl. No.: 12/955,527

(22) Filed: Nov. 29, 2010

(65) Prior Publication Data

US 2012/0133471 A1 May 31, 2012

(51) Int. Cl.
*H01F 5/00* (2006.01)
*H01F 27/28* (2006.01)
*H01F 17/00* (2006.01)

(52) U.S. Cl.
CPC ..... *H01F 5/003* (2013.01); *H01F 27/2804* (2013.01); *H01F 2017/0046* (2013.01); *H01F 2027/2809* (2013.01)

(58) Field of Classification Search
CPC ..... H01F 2017/0046
USPC ..... 336/200
See application file for complete search history.

(56) References Cited

U.S. PATENT DOCUMENTS 3,801,114 A * 4/1974 Bentley ..... 277/559
5,610,433 A * 3/1997 Merrill et al. ..... 257/531
6,608,364 B2 * 8/2003 Carpentier ..... 257/531
6,801,114 B2 10/2004 Yang et al.
6,980,075 B2 * 12/2005 Mheen et al. ..... 336/200
7,039,381 B2 * 5/2006 Yang et al. ..... 455/292
7,570,144 B2 * 8/2009 Lim et al. ..... 336/200
7,633,368 B2 * 12/2009 Lee ..... 336/200
8,108,984 B2 * 2/2012 Gardner et al. ..... 29/602.1
8,344,479 B2 * 1/2013 Pitts et al. ..... 257/531
2002/0093414 A1 * 7/2002 Wong ..... H01F 17/0006 336/200
2002/0130387 A1 * 9/2002 Carpentier ..... 257/531
2004/0017278 A1 * 1/2004 Castaneda et al. ..... 336/200
2005/0030145 A1 * 2/2005 Kyriazidou et al. ..... 336/200
2006/0022787 A1 * 2/2006 Brennan ..... H01F 17/0006 336/200
2007/0268105 A1 * 11/2007 Walls ..... 336/200
2008/0174396 A1 * 7/2008 Choi ..... H01F 27/2804 336/182

(Continued)

OTHER PUBLICATIONS

Kuroda, T. et al., "CMOS Proximity Wireless Communications for SiP Integration," ISSCC 2007 Circuit Design Forum, Feb. 11, 2007, Keio University, 30 pgs.

(Continued)

*Primary Examiner* — Mangtin Lian
*Assistant Examiner* — Ronald Hinson
(74) *Attorney, Agent, or Firm* — Slater Matsil, LLP

(57) ABSTRACT

A device includes a first plurality of dielectric layers over a substrate and a second plurality of dielectric layers over the first plurality of dielectric layers. A metal inductor includes a first metal portion, a second metal portion, a third metal portion, and a fourth metal portion, wherein each of the first, the second, the third, and the fourth metal portions extends into the first and the second plurality of dielectric layers. A first metal bridge connects the first metal portion to the second metal portion, wherein the first metal bridge extends into the first plurality of dielectric layers and not into the second plurality of dielectric layers. A second metal bridge connects the third metal portion to the fourth metal portion, wherein the second metal bridge extends into the second plurality of dielectric layers and not into the first plurality of dielectric layers.

19 Claims, 6 Drawing Sheets

(56) References Cited

U.S. PATENT DOCUMENTS

| | | | | |
|---|---|---|---|---|
| 2010/0164069 | A1* | 7/2010 | Jou | H01F 23/5227 257/547 |
| 2010/0164667 | A1* | 7/2010 | Ho-Hsiang | 336/137 |
| 2011/0221560 | A1* | 9/2011 | Chen et al. | 336/200 |
| 2012/0018878 | A1* | 1/2012 | Cheng | H01F 21/4853 257/737 |

OTHER PUBLICATIONS

Miura, N. et al., "Analysis and Design of Transceiver Circuit and Inductor Layout for Inductive Inter-Chip Wireless Superconnect," 2004 Symposium on VLSI Circuits, Digest of Technical Papers, IEEE, pp. 246-249.

Miura, N. et al., "An 8Tb/s 1pJ/b 0.8mm$^2$/Tb/s QDR Inductive-Coupling Interface Between 65nm CMOS GPU and 0.1μm DRAM," ISSCC 2010/Session 24/DRAM & Flash Memories/24.3, 2010 IEEE International Solid-State Circuits Conference, Keio University, Yokohama, Japan, pp. 436-438.

Niitsu, K. et al., "A 33% Improvement in Efficiency of Wireless Inter-Chip Power Delivery by Thin Film Magnetic Material," Extended Abstracts of the 2008 International Conference on Solid State Devices and Materials, Tsukuba, 2008, pp. 492-493.

* cited by examiner

HIGH-K TRANSFORMERS EXTENDING INTO MULTIPLE DIELECTRIC LAYERS

BACKGROUND

Transformers are widely used in the wireless communication, such as chip-to-chip wireless communication, in which signals are transmitted from one chip to a neighboring chip wirelessly. One application of the chip-to-chip wireless communication is the signal transmission between a memory (for example, a dynamic random access memory (DRAM)) and a graphics processing unit (GPU). Due to the big number of transformers that may be used in the chip-to-chip wireless communication, the coupling-coefficients (k) of the transformers became a very important factor for reducing power consumption, for increasing communication distances, and for increasing signal-to-noise ratios.

Conventionally, to improve the k values of transformers that include two inductors formed on different chips, various approaches have been taken, which include reducing the thickness of chips so that the distances between the inductors may be reduced. This requires the chips to be ground to a very small thickness, and hence the process complexity in the handling of the respective wafers and chips is increased, and a higher cost may be involved. The improvement in the k values of the transformers may also be achieved by increasing areas of the transformers, and increasing magnetic flux density in the transformers. These methods, however, cause the chip area occupied by the transformers to be increased. For applications in which many transformers are involved, the increase in the chip area may be significant.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative, and do not limit the scope of the disclosure.

A novel transformer and the method of forming the same are provided in accordance with an embodiment. The variations and the operation of the embodiment are then discussed. Throughout the various views and illustrative embodiments, like reference numbers are used to designate like elements. In the subsequent discussion, an inductor may be referred to as a transformer, since it may be a part of a transformer that includes two inductors formed on two chips.

Figure 1:
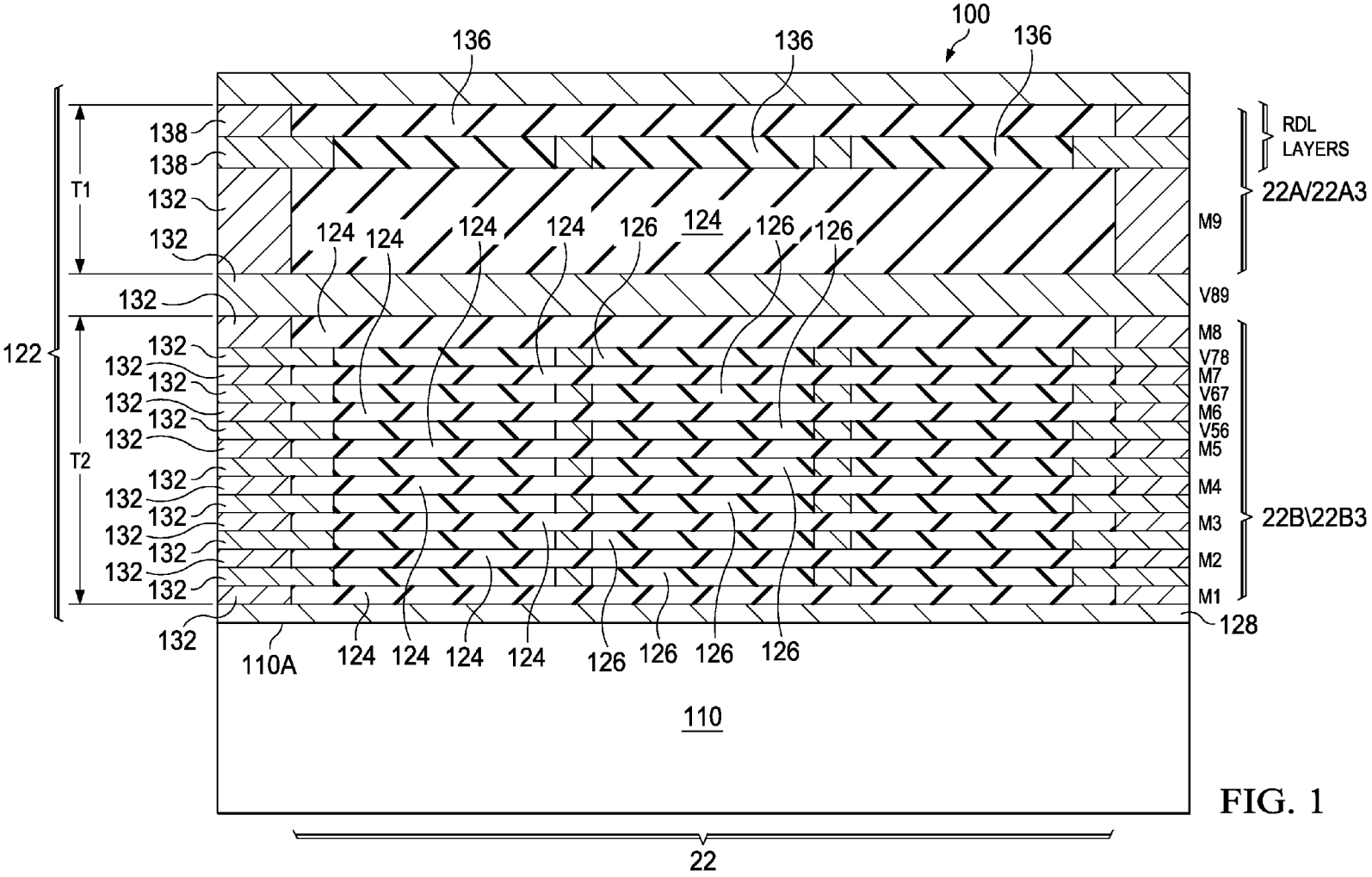
FIG. 1 illustrates a cross-sectional view of metal bridge portions of an inductor formed in a chip.

FIG. 1 illustrates a cross-sectional view of a portion of a wafer or a chip (referred to as wafer/chip hereinafter) 100, in which inductor 22 is formed. Wafer/chip 100 includes substrate 110, which may be an organic substrate, a ceramic substrate, or a semiconductor substrate such as a silicon crystalline substrate. Active devices such as transistors (not shown) may be formed at top surface 110A of semiconductor substrate 110. Inductor 22 may be used to form a primary or secondary part (winding) of transformer 222 (not shown in FIG. 1, please refer to FIG. 6). Interconnect structure 122, which includes metal lines 124 and vias 126 formed therein and electrically coupled to the semiconductor devices, is formed over substrate 110. Metal lines 124 and vias 126 may be formed of copper or copper alloys, and may be formed using damascene processes. Interconnect structure 122 may include inter-layer dielectric (ILD) 128 and inter-metal dielectrics (IMDs) 132.

IMDs 132 may include a plurality of dielectric layers. The metal layers in IMDs 132 are referred to as metal layers M1 through Mtop, with the metal layers including metal lines 124 and vias 126. Metal layer M1 is the bottom metal layer over substrate 110, with no additional metal layer under metal layer M1 and over substrate 110. Metal layer Mtop is the top metal layer formed in low-k dielectric layer. Metal layers M1 through Mtop may be formed of copper or copper alloys. In an exemplary embodiment, metal layer M9 is metal layer Mtop. However, depending on the number of IMD layers 132, the integer "top" may represent an integer greater or smaller than 9. IMDs 132 may be low-k dielectric layers having k values lower than about 3.0 or 2.5, for example. Redistribution line (RDL) layer(s), which may comprise one or more layers, may be formed over IMDs 132. The RDL layers may include metal line portions and via portions, which are referred to as RDLs 136. RDLs 136 may be formed of aluminum, aluminum copper, or the like. Dielectric layer(s) 138, in which RDLs 136 are formed, may be formed of non-low-k dielectric materials (which have dielectric constants greater than 3.8), such as un-doped silicate glass (USG), silicon oxide, silicon nitride, or multi-layers thereof.

FIG. 1 also illustrates a cross-sectional view of a portion of inductor 22, which comprises metal lines 124, vias 126, and optionally RDLs 136 that are electrically coupled to each other. It is appreciated that chip/wafer 100 may include a plurality of inductors 22, although FIG. 1 only illustrates one inductor 22. The cross-sectional view as shown in FIG. 1 may be obtained from the planes crossing lines 1-1 in FIG. 4.

Figure 2:
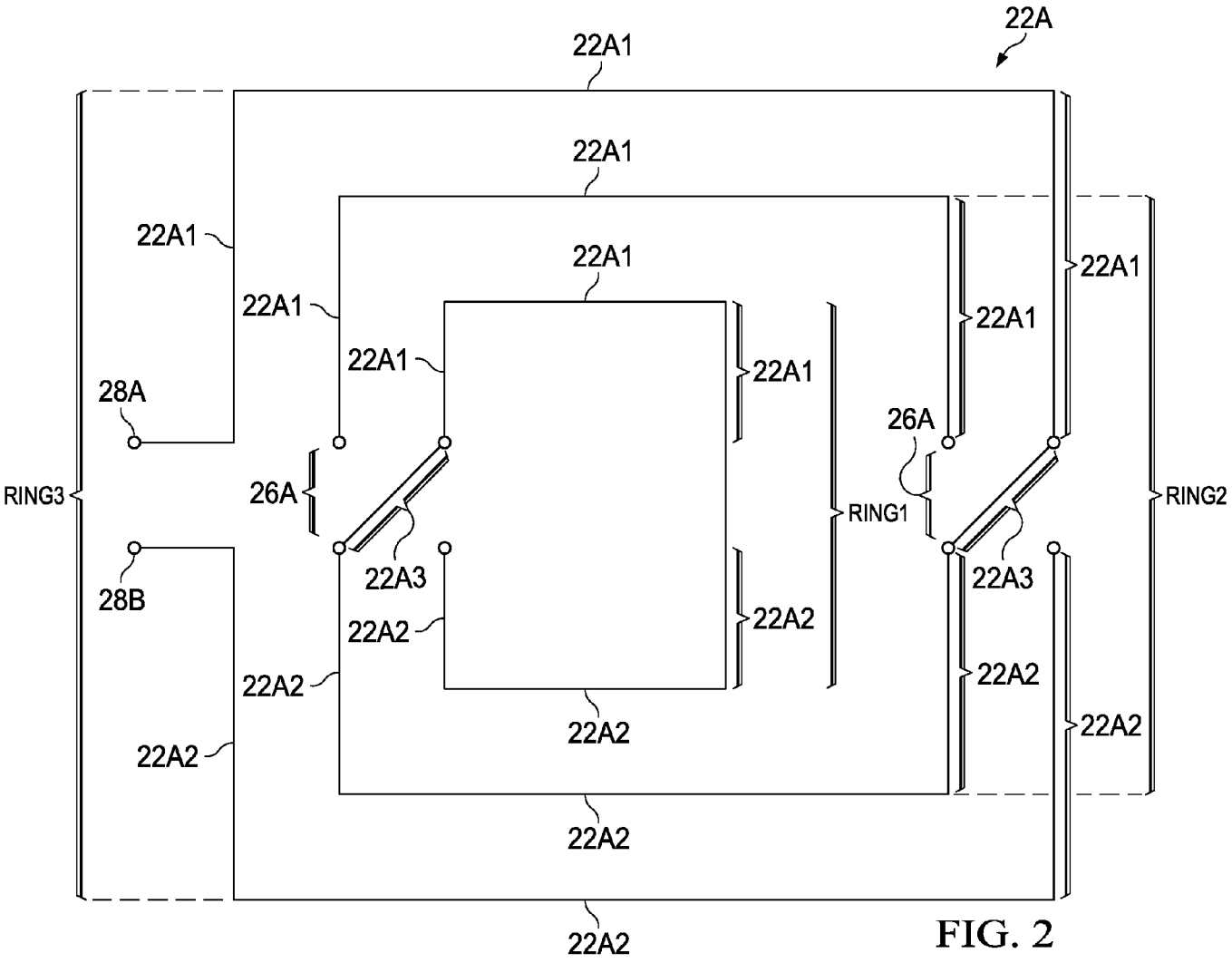
FIGS. 2 and 3 are top views of an upper portion and a lower portion of an inductor, respectively.
Figure 3:
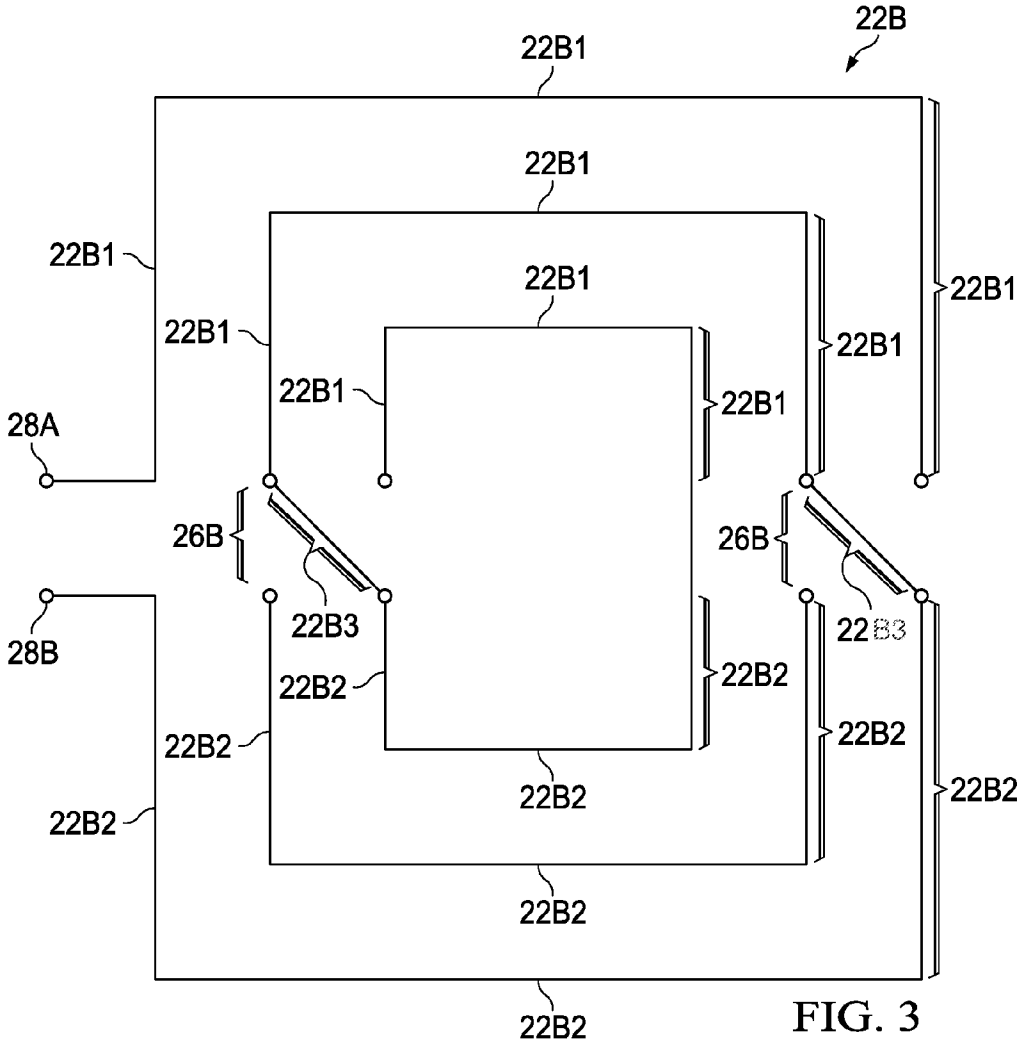

FIGS. 2 and 3 illustrate top views of inductor 22, wherein the top view shown in FIG. 2 represents upper portion 22A (also see FIG. 1) of inductor 22. Upper portion 22A is located in upper ones of metal layers M1 through Mtop and RDLs. The top view shown in FIG. 3 represents lower portion 22B of inductor 22, wherein the lower portion 22B is located in lower ones of metal layers M1 through Mtop, and possibly RDLs (also refer to FIG. 1). Portions of upper portion 22A of inductor 22 may be directly over and overlapping portions of lower portion 22B.

Referring back to FIG. 1, in an embodiment, upper portion 22A extends from the top layer of the RDLs to one of the metal layers M1 through M9. For example, upper portion 22A may include portions in each of the RDLs and M9. Correspondingly, lower portion 22B extends into each of metal layers M1 through M8. In alternative embodiments, the bottom metal layer of lower portion 22B may be any of the metal layers over, and not including, metal layer M1. For example, the lower portion 22B may include metal layers M2 through M8, M3 through M8, or the like. In the embodiments M9 belongs to upper portion 22A, and M8 belongs to lower portion 22B, the via layer V89, which is between metal layers M8 and M9, is the dividing via layer that divides upper portion 22A from lower portion 22B. Alternatively, the dividing layer may be via layers V78, V67, or the like. In each of upper portion 22A and lower portion 22B, metal lines 124 and vias 126 are formed in each of the corresponding metal layers and via layers, so that from the top layer to the bottom layer of each of upper portion 22A and lower portion 22B, metal lines 124 and vias 126 are connected to form an integrated and continuous metal feature.

Referring again to FIG. 1, the total thickness T1 of upper portion 22A may be close to the total thickness T2 of lower portion 22B, wherein thicknesses T1 and T2 are measured in the direction perpendicular to major surface 110A of substrate 110. Accordingly, the selection of the dividing layer that separates upper portion 22A from lower portion 22B is related to the thicknesses of metal layers M1 through RDL. Since the upper ones of metal layers M1 through M9 may be thicker than the lower ones, upper portion 22A may include fewer layers than lower portion 22B. In an embodiment, a value $|(T1-T2)/(T1+T2)|$ may be calculated to determine which dividing layer is the optimal layer, which means that if this dividing layer is used, thickness T1 of upper portion 22A is closest to thickness T2 of lower portion 22B. Alternatively stating, the optimal dividing scheme has an effect that if one more layer in upper portion 22A is re-divided into lower portion 22B, or one more layer in lower portion 22B is re-divided into upper portion 22A, the value $|(T1-T2)/(T1+T2)|$ will increase.

Referring again to FIG. 2, the illustrated upper portion 22A includes a plurality of semi-turns, wherein two of the semi-turns 22A in combination may form a ring-like structure (such as ring1, ring2, or ring3), which is close to a ring, except the ring-like structure has at least one break, and possibly two breaks therein. Throughout the description, the term "semi-turn" is used to refer to a shape close to a half (a 180-degree turn) of a ring, and two semi-turns in combination may form a ring-like structure (a 360 degree turn). In the exemplary embodiment as shown in FIG. 2, each of the semi-turns 22A1 and 22A2 includes three sections, with the middle section connected between, and perpendicular to, the other two sections. Semi-turns 22A1 and 22A2 form three ring-like structures ring1, ring2, and ring3, with breaks 26A in each of ring-like structures. Furthermore, ring-like structures ring1, ring2, and ring3 may form a concentric pattern, with outer ones of the ring-like structures ring1, ring2, and ring3 surrounding/encircling the inner ones. Bridges 22A3 may be formed to interconnect the semi-turns that belong to different ring-like structures ring1, ring2, and ring3.

Similarly, in FIG. 3, the illustrated lower portion 22B also includes a plurality of semi-turns 22B1 and 22B2 that are vertically overlapping the corresponding semi-turns of upper portion 22A, wherein two of the semi-turns of lower portion 22B in combination may form a ring-like structure. For example, semi-turns 22B1 and 22B2 form a ring-like structure, with breaks 26B therein. In addition, the ring-like structures in lower part 22B may form a concentric pattern, with outer ones of the ring-like structures surrounding the inner ones. Bridges 22B3 may be formed to interconnect the semi-turns that belong to different ring-like structures. In the exemplary embodiment as shown in FIG. 3, each of the semi-turns 22B1 and 22B2 includes three sections, with the middle section connected between, and perpendicular to, the other two sections.

Figure 4:
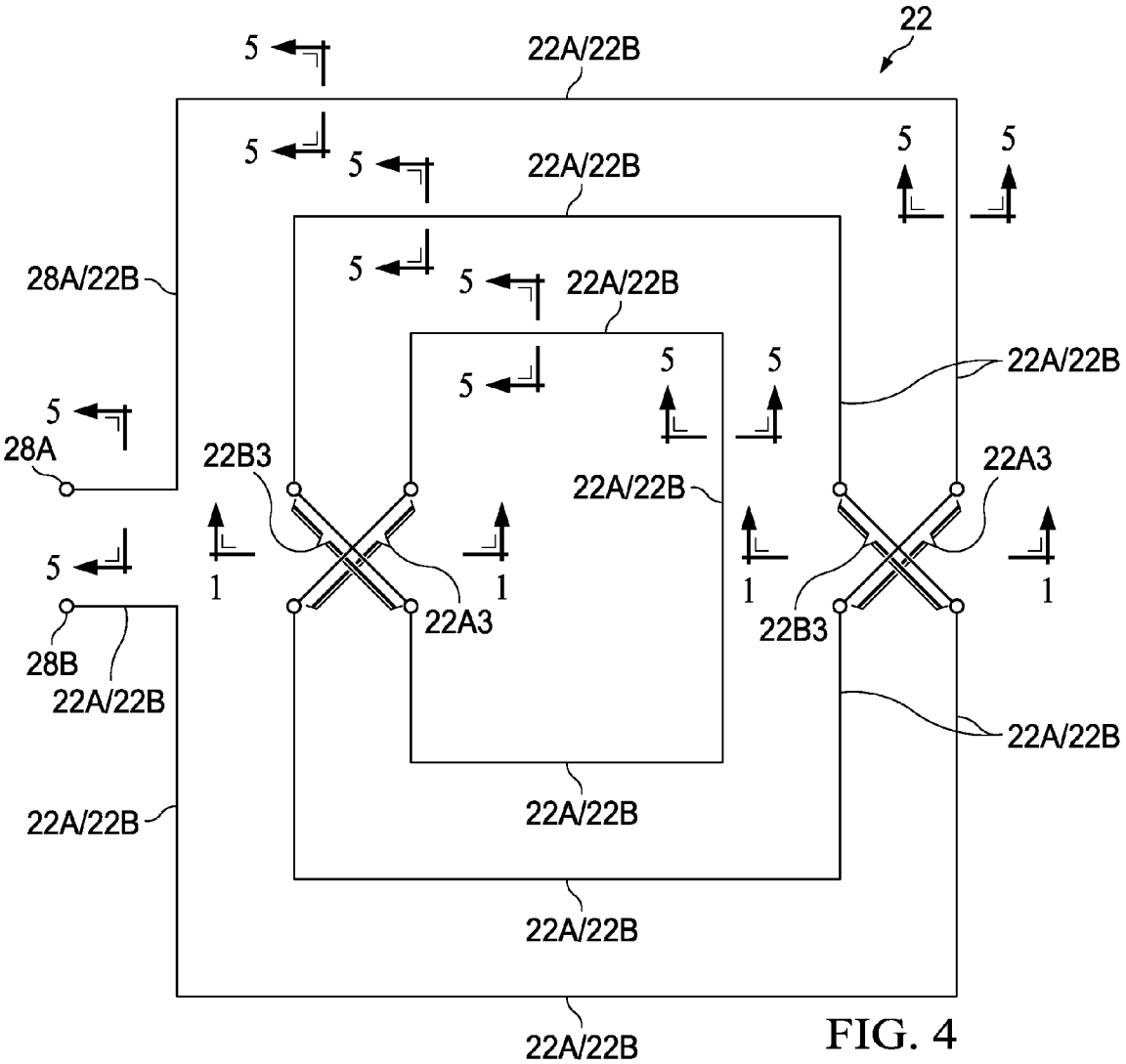
FIG. 4 illustrates a combined top view of the structures shown in FIGS. 2 and 3.

FIG. 4 illustrates a top view of inductor 22, with both upper portion 22A and lower portion 22B shown in FIG. 4. The cross-sectional view shown in FIG. 1 may be obtained from the planes crossing lines 1-1 in FIG. 4. Metal bridges 22A3 and 22B3 cross each other in the top view. Semi-turns 22A1 (FIG. 2) and the corresponding underlying semi-turns 22B1 (FIG. 3) include portions vertically overlap each other, and semi-turns 22A2 (FIG. 2) and the corresponding semi-turns 22B2 (FIG. 3) include portions vertically overlap each other, wherein the overlapped portions are marked as 22A/22B in FIG. 4. Semi-turns 22A and 22B are further connected to ports 28A and 28B, at which points the transformer also extend from M1 through RDL.

Figure 5:
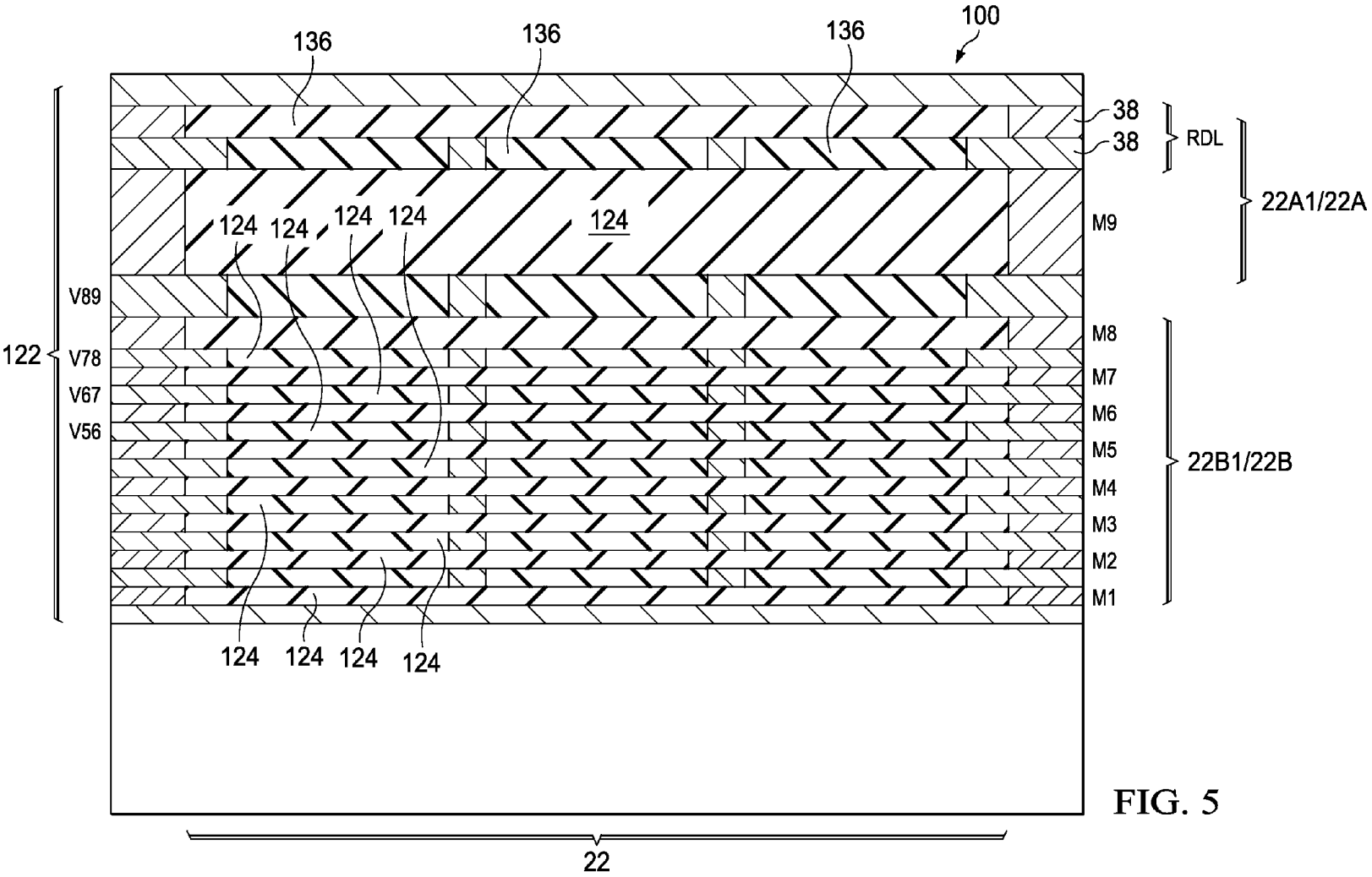
FIG. 5 illustrates semi-turn portions of the inductor shown in FIGS. 2 through 4.

FIG. 5 illustrates a cross-sectional view of a semi-turn portion of inductor 22, wherein the cross-sectional view is obtained along planes crossing lines 5-5 in FIG. 4. It is observed that the semi-turns such as 22A1 of upper portion 22A and the respective underlying semi-turns 22B1 of lower portion 22B are integrated as a single integrated semi-turn through metal via(s) in the dividing layer (via layer V89 in the illustrated example) that separates upper portion 22A from lower portion 22B. Accordingly, in the semi-turn portions, metal lines 124 and vias 126 are formed in each of the corresponding metal layers and via layers, so that metal lines 124 and vias 126, and RDLs 136 are connected to form an integrated metal feature extending all the way from metal layer M1 to RDL.

Combining FIGS. 1 through 5, it is observed that inductor 22 may include first portions (semi-turns, for example) that extends through a plurality of metal layers, which may be metal layers M1 through the top layer of the RDLs. Metal bridges 22A3, on the other hand, extends through the upper ones, but not into the lower ones, of the plurality of metal layers, while metal bridges 22B3 extends through the lower ones, but not into the upper ones, of the plurality of metal layers. As shown in FIG. 1, which illustrates metal bridge portions of inductor 22, metal bridges 22A3 and 22B3 are physically separated from each other by a dividing layer (for example, via layer V89), although different dividing layers such as via layers V67 or V56 may be used. Further, the dividing layer may include more than one via layer. For example, the dividing layer may include via layer V78 and additional layers such as M8, and may include a plurality of layers such as via layer V67 and V78 and metal layer M8.

In FIGS. 2 through 4, semi-turns 22A1, 22A2, 22B1, and 22B2, and the respective ring-like structures ring1, ring2, and ring3 are shown as having a square or a squares-like shape with breaks therein. In alternative embodiments, other shapes may be adopted by semi-turns 22A1, 22A2, 22B1, and 22B2 to form ring-like structures, which shapes include, but are not limited to, circles, ellipses, and the like. Furthermore, each of inductors 22 may include a plurality of ring-like structures, such as two, four, five, or more, with the outer ring-like structures encircling/surrounding the inner ring-like structures.

Further through FIGS. 1 through 5, it is observed that if a trace is made to trace the metal connection from port 28A to port 28B (FIG. 4), most portions (including semi-turns 22A1, 22A2, 22B1, and 22B2) of the metal trace extend from metal layers M1 all the way into redistribution layer RDLs. Accordingly, the resistances of these portions of inductor 22 are very low. The metal bridge portions 22A3 and 22B3 have the thicknesses close to a half of the thicknesses of the semi-turn portions, and hence the respective resistances are also low. Furthermore, evenly dividing upper portion 22A and the lower portion 22B of inductor 22 in thickness help make the resistances of metal bridges 22A3 and 22B3 more uniform.

As a result, the Q value of inductor 22 may be improved, and the k value of the respective transformer (not shown in FIGS. 1 through 5, please refer to FIG. 6) comprising inductor 22 is also improved.

Figure 6:
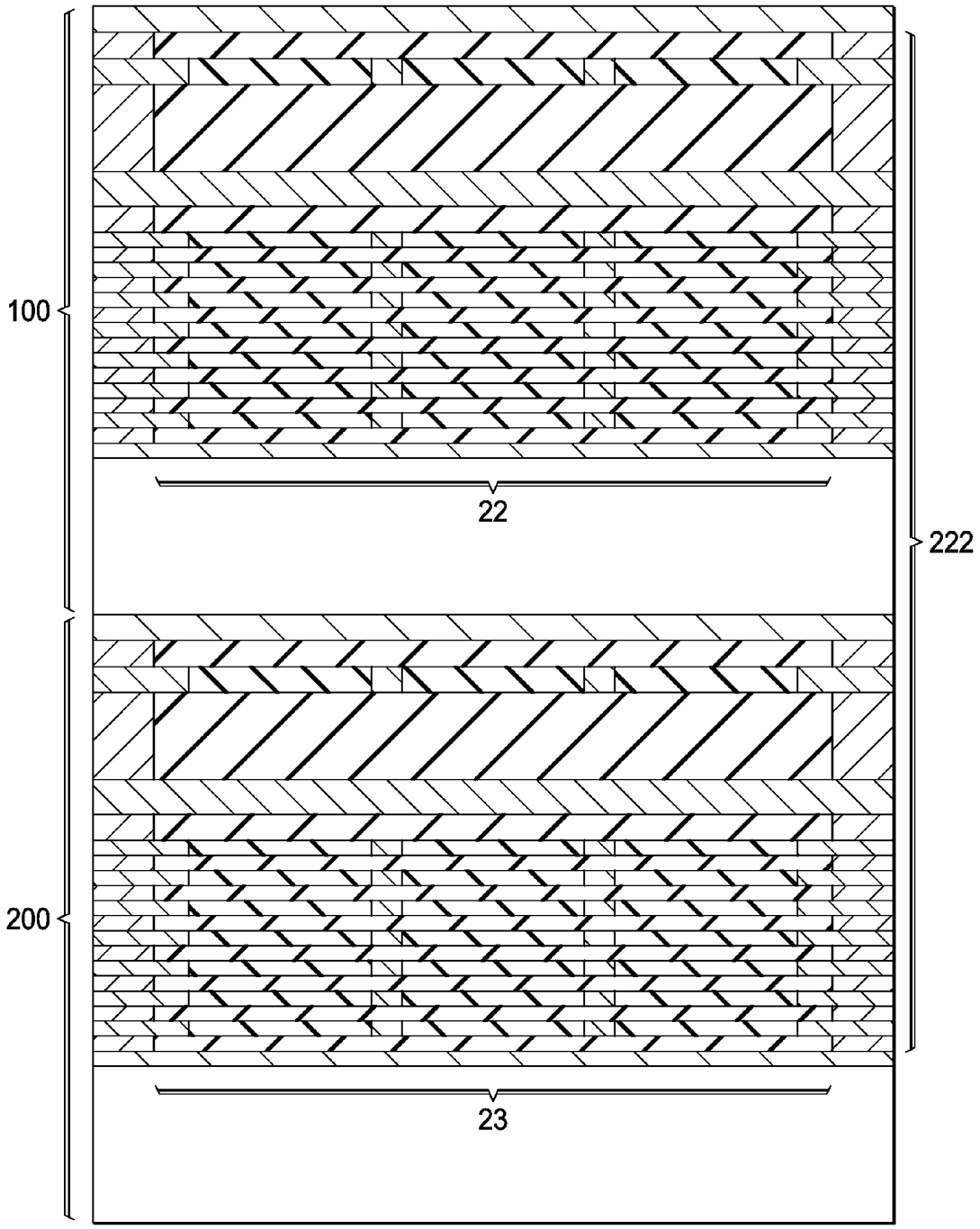
FIG. 6 illustrates a cross-sectional view of a portion of a transformer formed of two inductors, each in one of two chips, with the two chips bonded together.

FIG. 6 illustrates the two portions of transmitter 222 formed in chips 100 and 200. Inductor 22, which is in chip 100 and forms a portion of transformer 222, is essentially the same as shown in FIGS. 1 through 5. In chip 200, inductor 23 is formed, and may also have essentially the same structure as shown in FIGS. 1 through 5. Chips 100 and 200 may be stacked to each other through bonding, gluing, or other methods. Inductors 22 and 23 in combination form transmitter 222, wherein signals may be coupled between inductors 22 and 23. In an embodiment, the semi-turns in inductor 22 may vertically overlap the semi-turns (not shown) in inductor 23 after chips 100 and 200 are bonded.

The transformers formed according to embodiments have improved k values. Compared to conventional transformers formed in only metal layers M8 and M9 of chips, the k values of the transformers in accordance with embodiments may be as high as about 0.77, which is about 15 percent improvement over the k values 0.67 of conventional transformers. In experiments, the embodiments were used to form dynamic random access memory (DRAM) transceivers and graphic processing unit (GPU) transceivers, with inductor(s) 22 in FIG. 6 forming the transceivers of the DRAM, and inductor(s) 23 forming the transceivers of the GPU. The experiment results indicated that the total power consumptions of 1024 transceivers may be reduced to about 7 watts from 8 watts consumed by transceivers adopting conventional structures.

In accordance with embodiments, a device includes a first plurality of dielectric layers over a substrate and a second plurality of dielectric layers over the first plurality of dielectric layers. A metal inductor includes a first metal portion, a second metal portion, a third metal portion, and a fourth metal portion, wherein each of the first, the second, the third, and the fourth metal portions extends into the first and the second plurality of dielectric layers. A first metal bridge connects the first metal portion to the second metal portion, wherein the first metal bridge extends into the first plurality of dielectric layers and not into the second plurality of dielectric layers. A second metal bridge connects the third metal portion to the fourth metal portion, wherein the second metal bridge extends into the second plurality of dielectric layers and not into the first plurality of dielectric layers.

In accordance with other embodiments, a device includes a plurality of metal layers over a substrate, wherein the plurality of metal layers is formed of a first metallic material including copper; and at least one redistribution metal layer over the plurality of metal layers. The at least one redistribution metal layer is formed of a second metallic material including aluminum. A metal inductor includes a plurality of semi-turns forming ring-like structures, with outer ones of the ring-like structures encircling inner ones of the ring-like structures. Each of the plurality of semi-turns extends into each of the plurality of metal layers and the at least one redistribution metal layer. The metal inductor further includes a first plurality of metal bridges, each connecting two of the plurality of semi-turns in different one of the ring-like structures. Each of the first plurality of metal bridges extends into lower ones of the plurality of metal layers, and not into the at least one redistribution metal layer. The metal inductor further includes a second plurality of metal bridges, each connecting additional two of the plurality of semi-turns in different ring-like structures. Each of the second plurality of metal bridges extends into a top one of the plurality of metal layers and the at least one redistribution metal layer, and not into the lower ones of the plurality of metal layers.

In accordance with yet other embodiments, a device includes a first chip including a plurality of metal layers over a substrate. The plurality of metal layers is formed of a first metallic material including copper, and includes a bottom metal layer, a top metal layer, and metal layers between the bottom metal layer and the top metal layer. A first metal inductor is formed in the first chip and includes a top inductor layer not lower than the top metal layer, and a bottom inductor layer in the bottom metal layer. The first metal inductor includes a portion in each of the plurality of metal layers. The metal inductor further includes a first plurality of metal bridges, each extending into the bottom metal layer, and a second plurality of metal bridges over the first plurality of metal bridges. Each of the second plurality of metal bridges includes a portion level with the top inductor layer. A second chip is bonded to the first chip, with a second metal inductor formed in the second chip. The first and the second metal inductors overlap each other.

Although the embodiments and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A device comprising:

a substrate;

a first plurality of dielectric layers over the substrate;

a second plurality of dielectric layers over the first plurality of dielectric layers; and a first metal inductor comprising:

a lower portion comprising a first plurality of ring-like structures, wherein each of the first plurality of ring-like structures extends into each of the first plurality of dielectric layers, wherein each of the first plurality of ring-like structures comprises first metal lines and first vias interconnecting the first metal lines;

an upper portion overlying the lower portion, the upper portion comprising a second plurality of ring-like structures, wherein each of the second plurality of ring-like structures extends into each of the second plurality of dielectric layers, wherein each of the second plurality of ring-like structures comprises second metal lines and second vias interconnecting the second metal lines;

a first metal bridge interconnecting two of the first plurality of ring-like structures wherein the first metal bridge extends into each of the first plurality of dielectric layers and not into the second plurality of dielectric layers, wherein the first metal bridge comprises third metal lines and third vias interconnecting the third metal lines; and a second metal bridge interconnecting two of the second plurality of ring-like structures, wherein the second metal bridge extends into each of the second plurality of dielectric layers and not into the first plurality of dielectric layers, wherein the second metal bridge comprises fourth metal lines and fourth vias interconnecting the fourth metal lines, and wherein the first metal bridge and the second metal bridge are separated from each other by a dividing dielectric layer.

2. The device of claim 1, wherein the first plurality of ring-like structures forms a concentric pattern, with outer ones of the first plurality of ring-like structures encircling inner ones of the first plurality of ring-like structures, and wherein the second plurality of ring-like structures forms an additional concentric pattern, with outer ones of the second plurality of ring-like structures encircling inner ones of the second plurality of ring-like structures.

3. The device of claim 1, wherein each of the second plurality of ring-like structures overlaps a respective one of the first plurality of ring-like structure with a one-to-one correspondence to form a plurality of semi-turns, wherein each of the semi-turns comprises a first portion in the first plurality of ring-like structure and a second portion in the second plurality of ring-like structure, with the first portion and the second portion interconnected to form an integrated metal feature extends through all dielectric layers occupied by the first metal inductor.

4. The device of claim 1, wherein the first and the second metal bridges cross each other in a top view of the device, and wherein the second metal bridge comprises a portion directly over and overlapping a portion of the first metal bridge.

5. The device of claim 1, wherein each of the first plurality of ring-like structures penetrates through each of the first plurality of dielectric layers, each of the second plurality of ring-like structures penetrates through each of the second plurality of dielectric layers, the first metal bridge penetrates through each of the first plurality of dielectric layers, and the second metal bridge penetrates through each of the second plurality of dielectric layers.

6. The device of claim 1, wherein the first metal bridge comprise lower metal layers over the substrate, with the lower metal layers comprising copper, and the second metal bridges comprise upper metal layers comprising copper, and a redistribution layer comprising aluminum.

7. The device of claim 1, wherein the thickness of the first metal bridge is close to the thickness of the second metal bridge, with the thicknesses of the first and the second metal bridges measured in a direction substantially perpendicular to a major surface of the substrate.

8. The device of claim 1, wherein the first metal inductor is in a first chip, and the device further comprises:

a second chip bonded to the first chip; and a second metal inductor in the second chip, wherein the second metal inductor substantially vertically overlaps the first metal inductor, and forms a transformer with the first metal inductor.

9. A device comprising:

a substrate;

a plurality of metal layers over the substrate, wherein the plurality of metal layers is formed of a first metallic material comprising copper;

at least one redistribution metal layer over the plurality of metal layers, wherein the at least one redistribution metal layer is formed of a second metallic material comprising aluminum; and a first metal inductor comprising:

a lower portion comprising a first plurality of ring-like structures, with outer ones of the first plurality of ring-like structures encircling inner ones of the first plurality of ring-like structures, wherein each of the first plurality of ring-like structures extends into at least two of the plurality of metal layers, and wherein each of the first plurality of ring-like structures comprises first metal lines and first vias interconnecting the first metal lines;

an upper portion comprising a second plurality of ring-like structures, with outer ones of the second plurality of ring-like structures encircling inner ones of the second plurality of ring-like structures, wherein each of the second plurality of ring-like structures extends into the at least one redistribution metal layer, and wherein each of the second plurality of ring-like structures comprises second metal lines and second vias interconnecting the second metal lines;

a first plurality of metal bridges, each connecting two of the first plurality of ring-like structures, wherein each of the first plurality of metal bridges extends into each of the at least two of the plurality of metal layers, and each of the first plurality of metal bridges comprises third metal lines and third vias interconnecting the third metal lines; and a second plurality of metal bridges, each connecting additional two of the second plurality of ring-like structures, wherein each of the second plurality of metal bridges extends into each of the at least one redistribution metal layer, and each of the second plurality of metal bridges comprises fourth metal lines and fourth vias interconnecting the fourth metal lines, wherein the first plurality of metal bridges and the second plurality of metal bridges cross each other in a top view of the device, and wherein the second plurality of metal bridges comprises portions directly over and overlapping portions of the first plurality of metal bridges.

10. The device of claim 9, wherein a dielectric material of a via layer separates the second plurality of metal bridges from the first plurality of metal bridges.

11. The device of claim 9, wherein the first plurality of metal bridges is formed in low-k dielectric layers, and the second plurality of metal bridges is formed in at least one low-k dielectric layer and at least one non-low-k dielectric layer.

12. The device of claim 9, wherein the first metal inductor is in a first chip, and the device further comprises:

a second chip bonded to the first chip; and a second metal inductor in the second chip, wherein the second metal inductor substantially vertically overlaps the first metal inductor, and forms a transformer with the first metal inductor.

13. The device of claim 9, wherein each of the second plurality of ring-like structures overlaps a respective one of the first plurality of ring-like structure with a one-to-one correspondence to form a plurality of semi-turns, wherein two of the semi-turns that are physically disconnected from each other form a ring with two breaks, and each of the two of the semi-turns has two ends, each terminating at a metal bridge.

14. A device comprising:

a substrate;

a plurality of dielectric layers over the substrate, wherein the plurality of dielectric layers comprises:

a first plurality of dielectric layers, with a bottom dielectric layer being a bottommost layer of the first plurality of dielectric layers;

an intermediate dielectric layer over the first plurality of dielectric layers; and a second plurality of dielectric layers over the intermediate dielectric layer, with a top dielectric layer being a topmost layer of the second plurality of dielectric layers;

a metal inductor comprising:

a plurality of semi-turns, wherein each of the semi-turns continuously extends from a bottom surface of the bottom dielectric layer to a top surface of the top dielectric layer, wherein each of the plurality of semi-turns comprises first metal lines and first vias interconnecting the first metal lines, and wherein two semi-turns in the plurality of semi-turns are physically disconnected from each other, and are in combination form a ring with two breaks, and each of the two semi-turns have two ends, with each of the two ends terminating at a metal bridge;

a first metal bridge interconnecting first two of the plurality of semi-turns, wherein the first metal bridge extends into the first plurality of dielectric layers and not into the second plurality of dielectric layers and the intermediate dielectric layer, and wherein the first metal bridge comprises second metal lines and second vias interconnecting the second metal lines; and a second metal bridge interconnecting second two of the plurality of semi-turns, wherein the second metal bridge extends into the second plurality of dielectric layers and not into the first plurality of dielectric layers and the intermediate dielectric layer, and wherein the second metal bridge comprises third metal lines and third vias interconnecting the third metal lines.

15. The device of claim 14, wherein a topmost metal feature of the metal inductor is in the top dielectric layer, and a bottommost metal feature of the metal inductor is in the bottom dielectric layer.

16. The device of claim 14, wherein each of the a plurality of semi-turns includes a portion in each of the top dielectric layer, the bottom dielectric layer, and all dielectric layers between the top dielectric layer and the bottom dielectric layer.

17. The device of claim 14, wherein the second metal bridge comprises a portion overlapping a portion of the first metal bridge.

18. The device of claim 1, wherein one of the first plurality of ring-like structures comprises two semi-turns physically disconnected from each other, with each of the two semi-turns comprising two ends, wherein each of the two ends is connected to a metal bridge, and the two semi-turns in combination form a ring having two breaks on opposite sides of the ring.

19. The device of claim 9, wherein one of the first plurality of ring-like structures comprises two semi-turns physically disconnected from each other, with each of the two semi-turns comprising two ends, wherein each of the two ends is connected to a metal bridge, and the two semi-turns in combination form a ring having two breaks on opposite sides of the ring.

* * * * *